US006389803B1

(12) United States Patent
Surnilla et al.

(10) Patent No.: US 6,389,803 B1
(45) Date of Patent: May 21, 2002

(54) EMISSION CONTROL FOR IMPROVED VEHICLE PERFORMANCE

(75) Inventors: Gopichandra Surnilla, West Bloomfield; David Karl Bidner, Livonia, both of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/630,478

(22) Filed: Aug. 2, 2000

(51) Int. Cl.[7] ..... F01N 3/00

(52) U.S. Cl. ..... 60/276; 60/274; 60/285; 205/781

(58) Field of Search ..... 60/274, 276, 285, 60/301; 205/781, 784, 784.5, 785

(56) References Cited

U.S. PATENT DOCUMENTS

| | | | |
|---|---|---|---|
| 3,696,618 | A | 10/1972 | Boyd et al. |
| 3,969,932 | A | 7/1976 | Rieger et al. |
| 4,033,122 | A | 7/1977 | Masaki et al. |
| 4,251,989 | A | 2/1981 | Norimatsu et al. |
| 4,622,809 | A | 11/1986 | Abthoff et al. |
| 4,854,123 | A | 8/1989 | Inoue et al. |
| 4,884,066 | A | 11/1989 | Miyata et al. |
| 4,913,122 | A | 4/1990 | Uchida et al. |
| 5,009,210 | A | 4/1991 | Nakagawa et al. |
| 5,088,281 | A | 2/1992 | Izutani et al. |

(List continued on next page.)

FOREIGN PATENT DOCUMENTS

| | | |
|---|---|---|
| DE | 196 07 151 C1 | 7/1997 |
| EP | 0 351 197 A2 | 1/1990 |
| EP | 0 444 783 A1 | 9/1991 |
| JP | 62-97630 | 5/1987 |
| JP | 62-117620 | 5/1987 |
| JP | 64-53042 | 3/1989 |
| JP | 2-30915 | 2/1990 |
| JP | 2-33408 | 2/1990 |
| JP | 2-207159 | 8/1990 |
| JP | 3-135417 | 6/1991 |
| JP | 5-26080 | 2/1993 |
| JP | 5-106493 | 4/1993 |
| JP | 5-106494 | 4/1993 |
| JP | 6-58139 | 3/1994 |
| JP | 6-264787 | 9/1994 |
| JP | 7-97941 | 4/1995 |

OTHER PUBLICATIONS

"An Air/Fuel Algorithm To Improve The NOx Conversion of Copper–Based Catalysts", by Joe Theis et al, SAE Technical Paper No. 922251, Oct. 19–22, 1992, pp. 77–89.

"Effect of Air–Fuel Ratio Modulation on Conversion Efficiency of Three–Way Catalysts", By Y. Kaneko et al., Inter–Industry Emission Control Program 2 (IIEC–2) Progress Report No. 4, SAE Technical Paper No. 780607, Jun. 5–9, 1978, pp. 119–127.

"Engineered Control Strategies For Improved Catalytic Control of NOx in Lean Burn Applications", by Alan F. Diwell, SAE Technical Paper No. 881595, 1988, pp. 1–11.

*Primary Examiner*—Thomas Denion
*Assistant Examiner*—Diem Tran
(74) *Attorney, Agent, or Firm*—Julia Voutyras; John D. Russell

(57) ABSTRACT

A method is presented for correcting the output of the $NO_x$ sensor during a time period starting with the end of the $NO_x$ purge cycle and ending when the amount of tail pipe $O_2$ exceeds a preselected value. During that period, fuel is being deposited on the $NO_x$ sensor thus causing an incorrect reading. Proper amount of $NO_x$ generated during that time is calculated by assuming that the NOx level during the incorrect reading is equal to the $NO_x$ reading after the end of the incorrect reading, and multiplying that amount by total integrated air mass. This method helps avoid unnecessary $NO_x$ purges and improves fuel economy.

23 Claims, 4 Drawing Sheets

U.S. PATENT DOCUMENTS 5,097,700 A 3/1992 Nakane
5,165,230 A 11/1992 Kayanuma et al.
5,174,111 A 12/1992 Nomura et al.
5,189,876 A 3/1993 Hirota et al.
5,201,802 A 4/1993 Hirota et al.
5,209,061 A 5/1993 Takeshima
5,222,471 A 6/1993 Stueven
5,233,830 A 8/1993 Takeshima et al.
5,267,439 A 12/1993 Raff et al.
5,270,024 A 12/1993 Kasahara et al.
5,272,871 A 12/1993 Oshima et al.
5,325,664 A 7/1994 Seki et al.
5,331,809 A 7/1994 Takeshima et al.
5,335,538 A 8/1994 Blischke et al.
5,357,750 A 10/1994 Ito et al.
5,377,484 A 1/1995 Shimizu
5,402,641 A 4/1995 Katoh et al.
5,412,945 A 5/1995 Katoh et al.
5,412,946 A 5/1995 Oshima et al.
5,414,994 A 5/1995 Cullen et al.
5,423,181 A 6/1995 Katoh et al.
5,426,934 A * 6/1995 Hunt et al. ..... 60/276
5,433,074 A 7/1995 Seto et al.
5,437,153 A 8/1995 Takeshima et al.
5,448,887 A 9/1995 Takeshima
5,450,722 A 9/1995 Takeshima et al.
5,472,673 A 12/1995 Goto et al.
5,473,887 A 12/1995 Takeshima et al.
5,473,890 A 12/1995 Takeshima et al.
5,483,795 A 1/1996 Katoh et al.
5,486,336 A * 1/1996 Dalla Betta et al. ..... 60/276
5,544,482 A 8/1996 Matsumoto et al.
5,551,231 A 9/1996 Tanaka et al.
5,577,382 A 11/1996 Kihara et al.
5,595,060 A 1/1997 Togai et al.
5,598,703 A 2/1997 Hamburg et al.
5,622,047 A 4/1997 Yamashita et al.
5,655,363 A 8/1997 Ito et al.
5,657,625 A 8/1997 Koga et al.
5,693,877 A 12/1997 Ohsuga et al.
5,713,199 A 2/1998 Takeshima
5,715,679 A 2/1998 Asanuma et al.
5,724,808 A 3/1998 Ito et al.
5,732,554 A 3/1998 Sasaki et al.
5,735,119 A 4/1998 Asanuma et al.
5,740,669 A 4/1998 Kinugasa et al.
5,743,084 A 4/1998 Hepburn
5,746,049 A 5/1998 Cullen et al.
5,746,052 A 5/1998 Kinugasa et al.
5,752,492 A 5/1998 Kato et al.
5,792,436 A 8/1998 Feeley et al.
5,839,274 A * 11/1998 Remboski et al. ..... 60/276
5,842,340 A 12/1998 Bush et al.
5,865,027 A 2/1999 Hanafusa et al.
5,953,907 A * 9/1999 Kato et al. ..... 60/276
5,970,707 A 10/1999 Sawada et al.
5,974,793 A 11/1999 Kinagusa et al.
5,983,627 A 11/1999 Asik
6,012,282 A * 1/2000 Kato et al. ..... 60/276
6,014,859 A 1/2000 Yoshizaki et al.
6,036,842 A * 3/2000 Kato et al. ..... 205/784.5
6,071,393 A * 6/2000 Oshima et al. ..... 204/425
6,093,294 A * 7/2000 Kato et al. ..... 205/781
6,143,165 A * 11/2000 Kurosawa et al. ..... 205/781
6,145,305 A * 11/2000 Itou et al. ..... 60/277
6,214,207 B1 * 4/2001 Miyata et al. ..... 205/781

* cited by examiner

EMISSION CONTROL FOR IMPROVED VEHICLE PERFORMANCE

FIELD OF THE INVENTION

The invention relates to a system and method for controlling an internal combustion engine coupled to an emission control device. More particularly, the invention relates to a system and method for controlling the internal combustion engine in response to a corrected $NO_x$ sensor output.

BACKGROUND OF THE INVENTION

Internal combustion engines are coupled to an emission control device known as a three-way catalytic converter designed to reduce combustion by-products such as carbon monoxide (CO), hydrocarbon (HC) and oxides of nitrogen ($NO_x$). Engines can operate at air-fuel mixture ratios lean of stoichiometry, thus improving fuel economy. However, the amount of $NO_x$ released during lean operation can be greater than that at rich operation or at stoichiometry, which compromises emission control in the vehicle. To reduce the amount of $NO_x$ released during lean operation, an emission control device known as a $NO_x$ trap, which is a 3-way catalyst optimized for $NO_x$ control, is usually coupled downstream of the three way catalytic converter. The $NO_x$ trap stores $NO_x$ when the engine operates lean. After the $NO_x$ trap is filled, stored $NO_x$ needs to be reduced and purged. In order to accomplish this, engine operation is switched from lean to rich or stoichiometric, i.e., the ratio of fuel to air is increased.

One method of determining when to end lean operation and to regenerate a $NO_x$ trap by operating the engine rich or near stoichiometry is described in EP 0,814,248. In particular, a sensor capable of measuring the amount of $NO_x$ in exhaust gas exiting from the $NO_x$ trap is installed downstream of the trap. The operation condition of the engine is switched from lean to stoichiometric ("stoic") or rich when the output value of the $NO_x$ sensor is greater than or equal to some predetermined value. This causes the nitrogen oxide absorbed in the $NO_x$ trap to be decomposed and discharged, and allows the engine to be operated under lean conditions again.

The inventors herein have recognized a disadvantage with the above approach. In particular, with certain No. sensors, when a $NO_x$ purge is performed, a small amount of reducing agent (for example, hydrocarbon or carbon monoxide) escapes through the $NO_x$ trap and is absorbed by the $NO_x$ sensor, thus saturating it. This can cause the sensor to give an erroneously high or low reading. This reading can cause over- or under-estimation of the tail-pipe $NO_x$, and therefore may cause unnecessary $NO_x$ purges, which can degrade fuel economy. Also, it may cause incorrect estimation of $NO_x$ in grams per mile and degrade vehicle emission strategy operation.

SUMMARY OF THE INVENTION

An object of the present invention is to provide a method for determining the correct amount of tail-pipe $NO_x$ emissions for a certain time period after a $NO_x$ purge, and for adjusting an engine control strategy in response to corrected $NO_x$ sensor output.

The above object is achieved and disadvantages of prior approaches overcome by a method for controlling an internal combustion engine coupled to an emission control device, the engine coupled to an exhaust sensor providing first and second signals respectively indicative of first and second quantities. The method includes the steps of determining when the second signal deviates from the second quantity based on the first signal; adjusting the second signal in response to said determining step; and adjusting an engine operating parameter based on the adjusted second signal.

An advantage of the above aspect of the invention is that a more precise method for calculating tailpipe $NO_x$ emissions is achieved, which improves fuel economy. By adjusting the $NO_x$ sensor reading during the period of reductant deposit on the sensor, it is possible to eliminate the effects of such deposit on the sensor. In other words, the more precise measurement of $NO_x$ makes it possible to eliminate unnecessary $NO_x$ purges, thus allowing the engine more lean running time, and improving fuel economy. Also, knowing a more accurate amount of $NO_x$ emissions allows for improved emission control strategy. It is an especially advantageous aspect of the present invention that a first output of the sensor can be used to determine when a second output of the sensor deviates from the parameter to be measured.

In another aspect of the present invention, the above object is achieved and disadvantages of prior approaches overcome by a method for controlling an internal combustion engine coupled to an emission control device, the engine coupled to an exhaust sensor providing a first signal and a second signal respectively indicative of an exhaust gas air-fuel ratio and a $NO_x$ level, the method including the steps of: determining the $NO_x$ level based on a first engine operating parameter when the first signal indicates the exhaust air-fuel ratio is richer than a first predetermined value;, determining the $NO_x$ level based on the second signal when the first signal indicates the exhaust air-fuel ratio is leaner than a second predetermined value and reductant deposited on the sensor is depleted by excess oxygen in the lean exhaust gas; and adjusting a second engine operating parameter based on the determined $NO_x$ level.

By using the actual $NO_x$ sensor reading in regions where it is indicative of actual $NO_x$, an accurate control system is obtained. Further, it is possible to determine when the $NO_x$ sensor reading deviates from the actual $NO_x$ level by monitoring the amount of oxygen in the exhaust gas. Therefore, when such deviation occurs, it is possible to make corrections to the $NO_x$ sensor reading. Also, it is possible to determine when the sensor starts reading correctly by determining when the reductant is oxidized by lean exhaust gas.

Other objects, features and advantages of the present invention will be readily appreciated by the reader of this specification.

BRIEF DESCRIPTION OF THE DRAWINGS

The object and advantages claimed herein will be more readily understood by reading an example of an embodiment in which the invention is used to advantage with reference to the following drawings herein:

DESCRIPTION OF THE INVENTION

Figure 1:
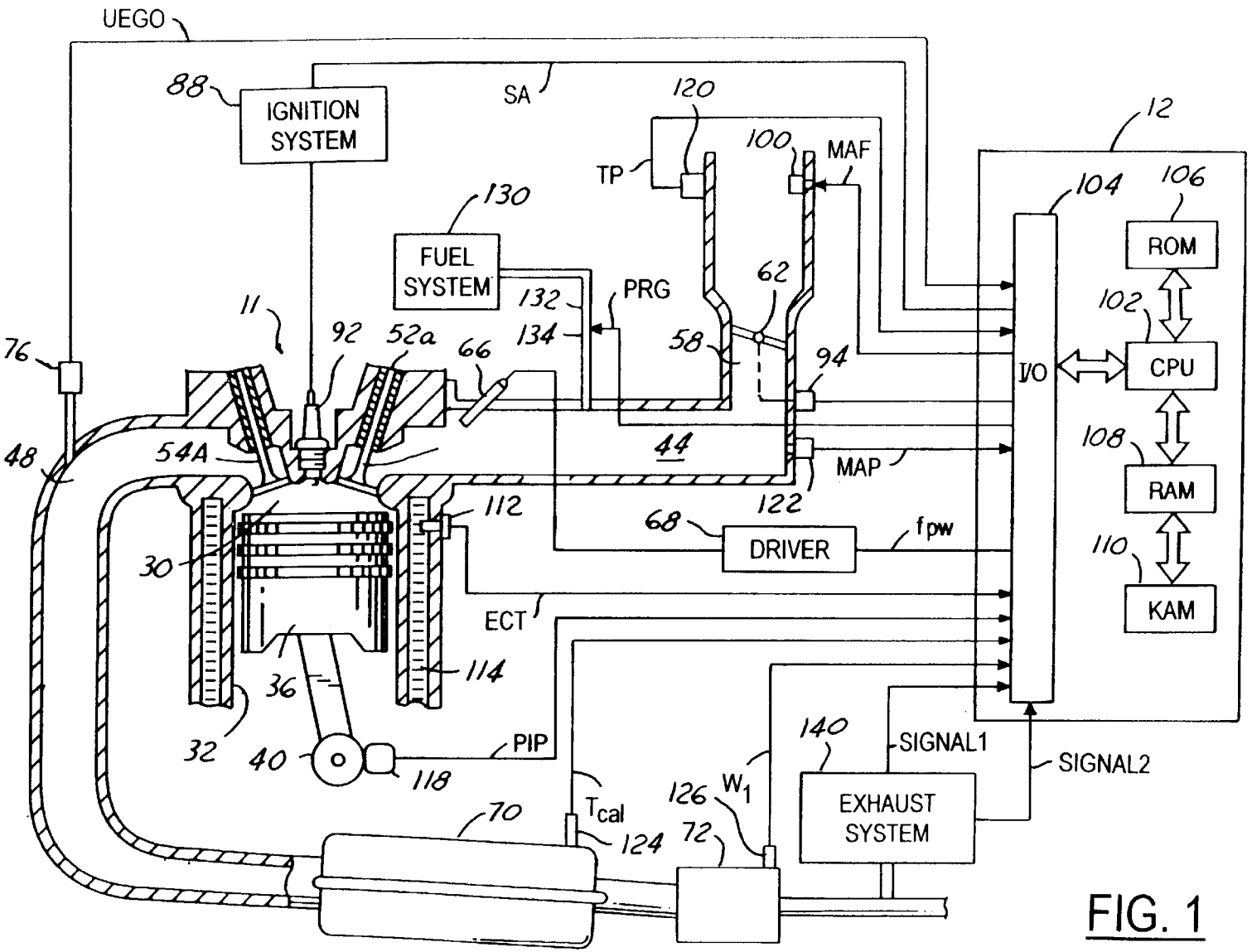
FIG. 1 is a block diagram of an internal combustion engine illustrating various components related to the present invention.

FIG. 1 shows a block diagram of a direct injection spark ignited (DISI) internal combustion engine 10 using the emission control system and method of the present invention. Typically, such an engine includes a plurality of combustion chambers only one of which is shown, and is controlled by electronic engine controller 12. Combustion chamber 30 of engine 10 includes combustion chamber walls 32 with piston 36 positioned therein and connected to crankshaft 40. In this particular example, the piston 30 includes a recess or bowl (not shown) for forming stratified charges of air and fuel. In addition, the combustion chamber 30 is shown communicating with intake manifold 44 and exhaust manifold 48 via respective intake valves 52*a* and 52*b* (not shown), and exhaust valves 54*a* and 54*b* (not shown). A fuel injector 66 is shown directly coupled to combustion chamber 30 for delivering liquid fuel directly therein in proportion to the pulse width of signal fpw received from controller 12 via conventional electronic driver 68. Fuel is delivered to the fuel injector 66 by a conventional high-pressure fuel system (not shown) including a fuel tank, fuel pumps, and a fuel rail.

Intake manifold 44 is shown communicating with throttle body 58 via throttle plate 62. In this particular example, the throttle plate 62 is coupled to electric motor 94 such that the position of the throttle plate 62 is controlled by controller 12 via electric motor 94. This configuration is commonly referred to as electronic throttle control (ETC), which is also utilized during idle speed control. In an alternative embodiment (not shown), which is well known to those skilled in the art, a bypass air passageway is arranged in parallel with throttle plate 62 to control inducted airflow during idle speed control via a throttle control valve positioned within the air passageway.

Exhaust gas oxygen sensor 76 is shown coupled to exhaust manifold 48 upstream of catalytic converter 70. In this particular example, sensor 76 provides signal UEGO to controller 12, which converts signal UEGO into a relative air-fuel ratio 1. Advantageously, signal UEGO is used during feedback air-fuel ratio control in a manner to maintain average air-fuel ratio at a desired air-fuel ratio as described later herein. In an alternative embodiment, sensor 76 can provide signal EGO (not show), which indicates whether exhaust air-fuel ratio is either lean of stoichiometry or rich of stoichiometry.

Conventional distributorless ignition system 88 provides ignition spark to combustion chamber 30 via spark plug 92 in response to spark advance signal SA from controller 12.

Controller 12 causes combustion chamber 30 to operate in either a homogeneous air-fuel ratio mode or a stratified air-fuel ratio mode by controlling injection timing. In the stratified mode, controller 12 activates fuel injector 66 during the engine compression stroke so that fuel is sprayed directly into the bowl of piston 36. Stratified air-fuel ratio layers are thereby formed. The strata closest to the spark plug contains a stoichiometric mixture or a mixture slightly rich of stoichiometry, and subsequent strata contain progressively leaner mixtures. During the homogeneous mode, controller 12 activates fuel injector 66 during the intake stroke so that a substantially homogeneous air-fuel ratio mixture is formed when ignition power is supplied to spark plug 92 by ignition system 88. Controller 12 controls the amount of fuel delivered by fuel injector 66 so that the homogeneous air-fuel ratio mixture in chamber 30 can be selected to be substantially at (or near) stoichiometry, a value rich of stoichiometry, or a value lean of stoichiometry. Operation substantially at (or near) stoichiometry refers to conventional closed loop oscillatory control about stoichiometry. The stratified air-fuel ratio mixture will always be at a value lean of stoichiometry, the exact air-fuel ratio being a function of the amount of fuel delivered to combustion chamber 30. An additional split mode of operation wherein additional fuel is injected during the exhaust stroke while operating in the stratified mode is available. An additional split mode of operation wherein additional fuel is injected during the intake stroke while operating in the stratified mode is also available, where a combined homogeneous and split mode is available.

Nitrogen oxide ($NO_x$) absorbent or trap 72 is shown positioned downstream of catalytic converter 70. $NO_x$ trap 72 absorbs $NO_x$ when engine 10 is operating lean of stoichiometry. The absorbed $NO_x$ is subsequently reacted with HC and other reductant sand catalyzed during a $NO_x$ purge cycle when controller 12 causes engine 10 to operate in either a rich mode or a near stoichiometric mode.

Controller 12 is shown in FIG. 1 as a conventional microcomputer including but not limited to: microprocessor unit 102, input/output ports 104, an electronic storage medium for executable programs and calibration values, shown as read-only memory chip 106 in this particular example, random access memory 108, keep alive memory 110, and a conventional data bus.

Controller 12 is shown receiving various signals from sensors coupled to engine 10, in addition to those signals previously discussed, including: measurement of inducted mass air flow (MAF) from mass air flow sensor 100 coupled to throttle body 58; engine coolant temperature (ECT) from temperature sensor 112 coupled to cooling sleeve 114; a profile ignition pickup signal (PIP) from Hall effect sensor 118 coupled to crankshaft 40 giving an indication of engine speed (RPM); throttle position TP from throttle position sensor 120; and absolute Manifold Pressure Signal MAP from sensor 122. Engine speed signal RPM is generated by controller 12 from signal PIP in a conventional manner and manifold pressure signal MAP provides an indication of engine load.

Fuel system 130 is coupled to intake manifold 44 via tube 132. Fuel vapors (not shown) generated in fuel system 130 pass through tube 132 and are controlled via purge valve 134. Purge valve 134 receives control signal PRG from controller 12.

Exhaust sensor 140 is a sensor that produces two output signals. First output signal (SIGNAL1) and second output signal (SIGNAL2) are both received by controller 12. Exhaust sensor 140 can be a sensor known to those skilled in the art that is capable of indicating both exhaust air-fuel ratio and nitrogen oxide concentration.

In a preferred embodiment, SIGNAL1 indicates exhaust air-fuel ratio and SIGNAL2 indicates nitrogen oxide concentration. In this embodiment, sensor 140 has a first chamber (not shown) in which exhaust gas first enters where a measurement of oxygen partial pressure is generated from a first pumping current. Also, in the first chamber, oxygen partial pressure of the exhaust gas is controlled to a predetermined level. Exhaust air-fuel ratio can then be indicated based on this first pumping current. Next, the exhaust gas enters a second chamber (not shown) where $NO_x$ is decomposed and measured by a second pumping current using the predetermined level. Nitrogen oxide concentration can then be indicated based on this second pumping current.

Figure 2:
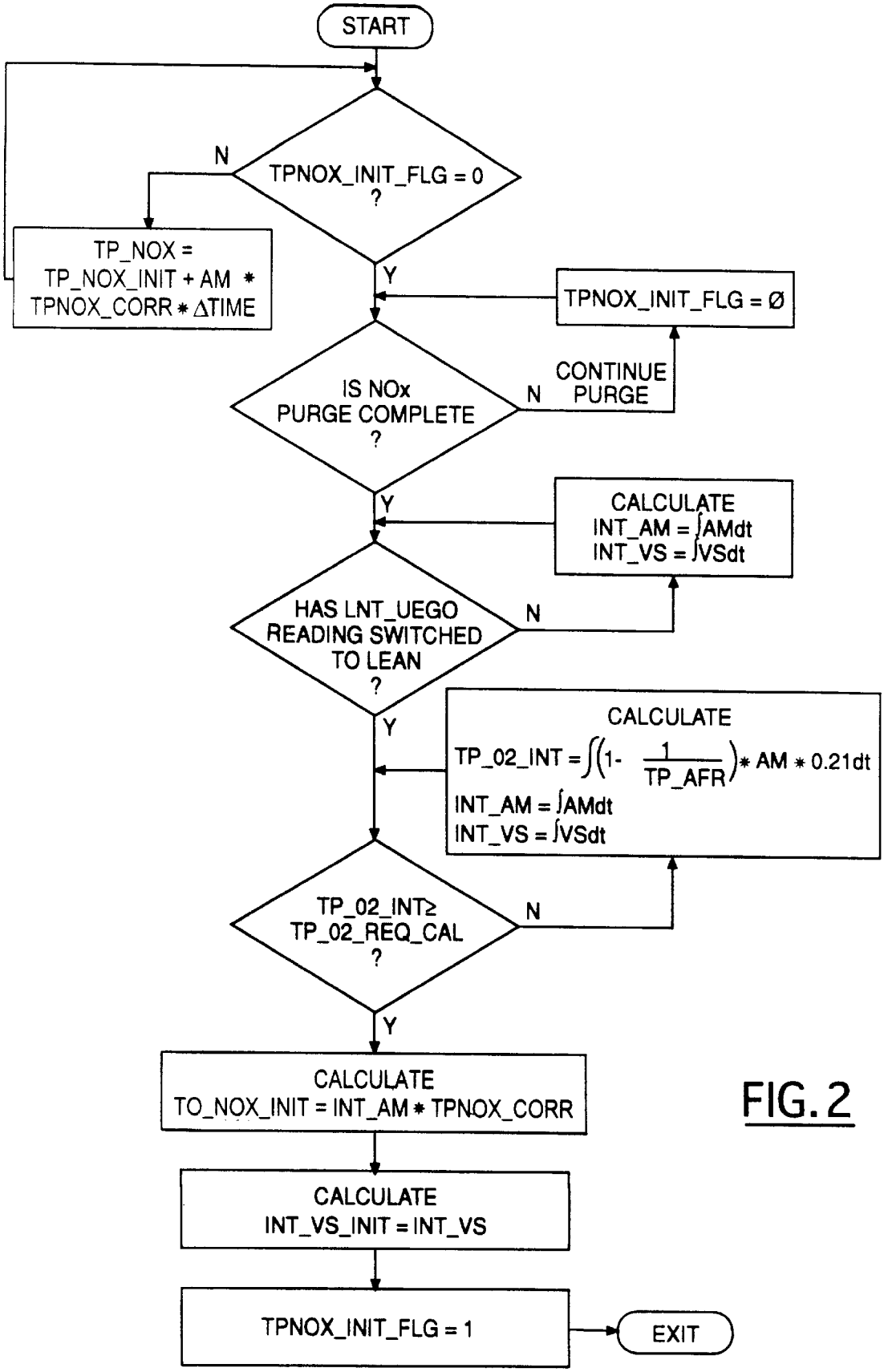
FIG. 2 is a block diagram of the embodiment in which the invention is used to advantage.

Referring to FIG. 2, a routine is described for correcting the error in the $NO_x$ sensor reading due to fuel or reductant deposit on the $NO_x$ sensor after the completion of the $NO_x$ purge due to reductant breakthrough of the trap. This routine also estimates the total amount of tailpipe $NO_x$ that was generated during the time that the sensor reading deviated from the actual value.

First, in step 900, a determination is made whether tpnox_init_flg is equal to zero. This flag is initialized at 0, and is set to one when the $NO_x$ sensor reading is correct. From the plot in FIG. 3 it can be shown that the $NO_x$ sensor reading becomes erroneous when the amount of oxygen ($O_2$) measured by the UEGO sensor downstream of the $NO_x$ trap falls just below a certain predetermined value (shown as occurring at time $t_1$ in FIG. 3), for example just below stoichiometry. The $NO_x$ sensor reading returns to normal when the $O_2$ amount is above a certain predetermined value (time $t_2$ in FIG. 3), for example just above stoichiometry. If the answer to step 900 is YES, the routine proceeds to step 920 whereupon a determination is made whether the $NO_x$ purge is completed. The $NO_x$ sensor reading becomes incorrect when the $NO_x$ purge is completed due to reductant breakthrough (corresponds to time period $t_1$ in FIG. 3). If the answer to step 920 is YES, a determination is made in step 940 whether the UEGO sensor reading has switched to lean, which would indicate the beginning of the dissipation of the fuel from the $NO_x$ sensing element. If the answer to step 940 is $NO_x$ the routine continues to step 950 where integrated air mass (int_am) and integrated vehicle speed (int_vs) are calculated according to the following formulas:

$$\text{int_}am = \int_0^t am \cdot dt$$

$$\text{int_}vs = \int_0^t vs \cdot dt$$

The routine then returns to step 940 and continues to cycle through steps 940-950 until the answer to step 940 becomes a YES, i.e., the UEGO sensor starts showing a switch to lean operation. If the answer to step 940 is YES, the routine proceeds to step 960, whereupon a determination is made whether the total amount of tailpipe $O_2$ is greater than or equal to a preselected constant, which in this example could be 20–30 grams. If the answer to step 960 is NO, the $NO_x$ sensor is still giving an incorrect reading, and the routine proceeds to step 970, where the total amount of tailpipe $O_2$, tp_o2_int, integrated air mass, int_am, and integrated vehicle speed, int_vs are calculated according to the following formulas:

$$tp_o2_\text{int} = \int_0^t (1 - 1/tp_afr) \cdot am \cdot 0.21 \cdot dt$$

$$\text{int_}am = \int_0^t am \cdot dt$$

$$\text{int_}vs = \int_0^t vs \cdot dt$$

Where tp_afr is the tailpipe air/fuel ratio, and am is the air mass. Next, the routine returns to step 960 to continue checking the change in the total amount of tailpipe $O_2$. When the answer to step 960 becomes a YES, and the total amount of tailpipe $O_2$ exceeds the predetermined level, it is assumed that the $N_x$ sensor starts reading correctly again, and the routine proceeds to step 980, and the total amount of tailpipe $NO_x$ during the time that the $NO_x$ sensor was in error, tpnox_init, is calculated. This corresponds to the time period $t_2$ in FIG. 3. It is assumed that the tailpipe $NO_x$ rate for the time period when the sensor was reading incorrectly, is the same as the tailpipe $NO_x$ rate, tpnox_corr, after the sensor starts reading correctly. Thus, the total amount of tailpipe $NO_x$ generated during the time that the sensor was reading incorrectly, can be calculated according to the following formula:

$$tp_nox_init = int_am \cdot tpnox_corr$$

Next, the routine proceeds to step 990 where int_vs_init (vehicle speed at the end of the erroneous reading period) is initialized to int_vs. Next, in step 1000, tpnox_init_flg is set to 1, indicating that the $NO_x$ sensor returned to reading correctly, and the routine exits.

If the answer to step 900 is NO, i.e. the flag is set to 1, indicating the return of the $NO_x$ sensor to correct reading, the routine proceeds to step 910, and the amount of tailpipe $NO_x$ is calculated as the sum of the $NO_x$ calculated during the erroneous sensor reading and the instantaneous amount of $NO_x$ generated during a period of time:

$$tp_nox = tpnox_init + am \cdot tpnox_corr \cdot \Delta time$$

The routine then returns to step 900, and continues monitoring for the change in the flag status.

Thus, according to the present invention, it is possible to correct the error in the $NO_x$ sensor reading during the time after a $NO_x$ purge when fuel is being deposited on the sensor. This is done by determining the time period during which the sensor reading was incorrect, assuming that during that time the tailpipe $NO_x$ rate was the same as the tailpipe $NO_x$ rate after the sensor starts reading correctly, and multiplying the correct $NO_x$ rate by the total air mass during the erroneous sensor operation. This method corrects the estimation of the tail pipe $NO_x$ which is used to evaluate $NO_x$ in grams per mile, and eliminates overestimation of the tail pipe Ng. thereby avoiding unnecessary $NO_x$ purges and improving fuel efficiency.

Figure 3:
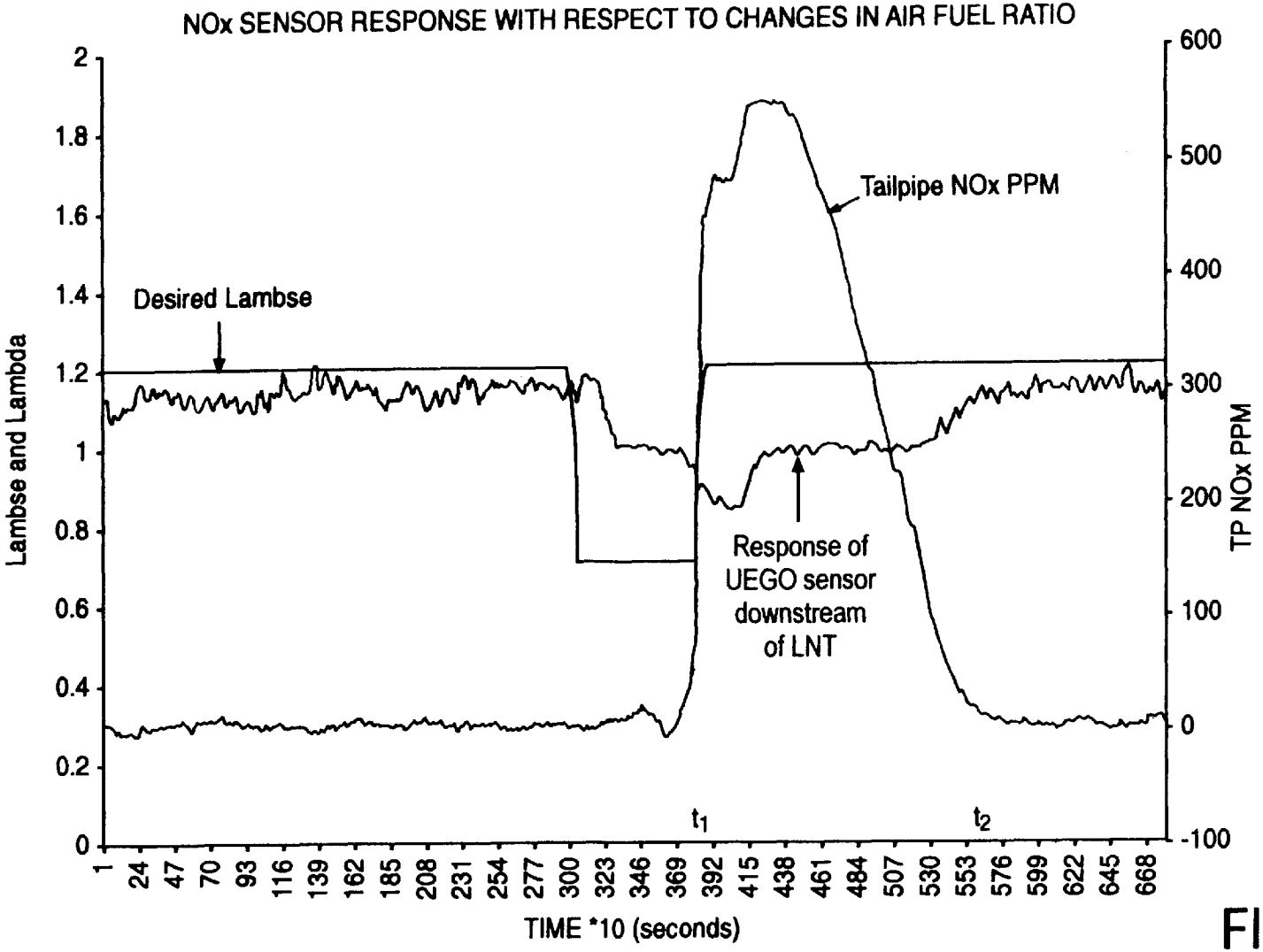
FIG. 3 is a graph of $NO_x$ sensor response with respect to changes in the air/fuel ratio.

Referring to FIG. 3, a plot of $NO_x$ sensor response to changes in the air/fuel ratio is presented. The $NO_x$ trap stores $NO_x$ released during lean engine operation. In order to purge $NO_x$ from the $NO_x$ trap, engine operation is switched from lean to rich, i.e. the air/fuel ratio is decreased over time. This causes the nitrogen oxide stored in the $NO_x$ trap to be decomposed and discharged from the trap. As the air/fuel ratio is being decreased, a small amount of reductant, such as fuel, escapes the $NO_x$ trap and saturates the $NO_x$ sensor placed downstream of the $NO_x$ trap. This causes the $NO_x$ sensor to give an erroneous reading starting at time $t_1$ This corresponds to the time when the UEGO sensor reading falls just below stoichiometry, and engine operation is switched from rich back to lean. After the $NO_x$ purge is completed, and the engine operation is switched back to lean, the UEGO sensor is reading close to stoic as the oxygen is being absorbed by the $NO_x$ trap. The residual oxygen, a small amount, escapes through the $NO_x$ trap and starts depleting fuel from the $NO_x$ sensor's chamber. The $NO_x$ sensor fuel is depleted completely only when a predetermined amount of oxygen is seen by the UEGO sensor. From the plot, it can clearly be seen that the $NO_x$ sensor reading is erroneous until the amount of oxygen seen by the UEGO exceeds a predetermined value, or until time $t_2$, i.e., until all of the reductant is depleted from the $NO_x$ sensor's chamber. After that, the $NO_x$ sensor reading returns to normal correct tailpipe $NO_x$ reading.

Figure 4:
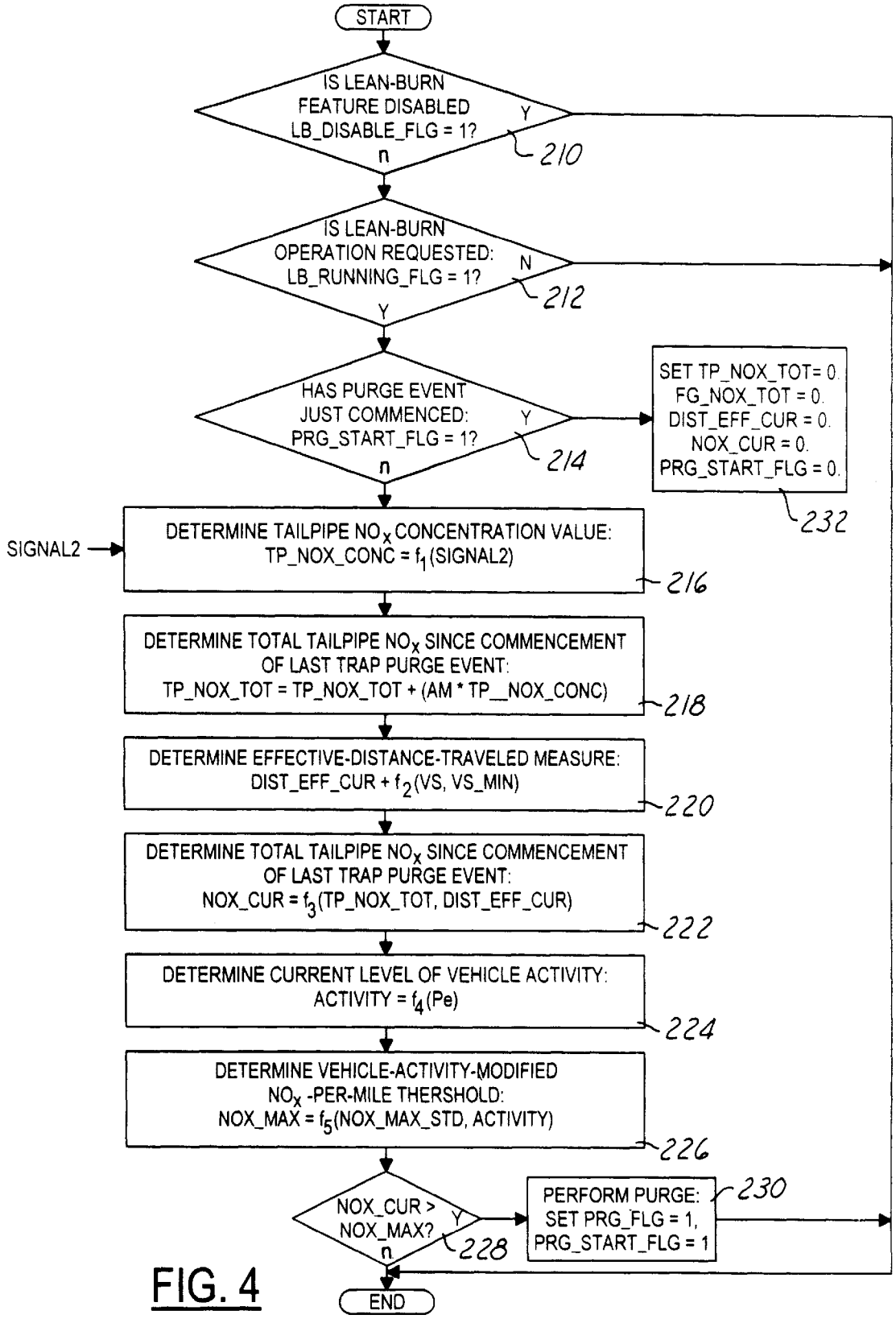
FIG. 4 is a flow chart depicting exemplary control methods used by the exemplary system.

Referring to FIG. 4, a routine is now described for controlling the engine based on the proper estimate of the tailpipe $NO_x$ emissions. After the controller 12 has confirmed at step 210 that the lean-burn feature is not disabled and, at step 212, that lean-burn operation has otherwise been requested, the controller 12 conditions enablement of the lean-burn feature, upon determining that adjusted tailpipe $NO_x$ emissions as calculated in step 910, FIG. 2, do not exceed permissible emissions levels. Specifically, after the controller 12 confirms that a purge event has not just commenced (at step 214), for example, by checking the current value of a suitable flag PRG_START_FLG stored in KAM, the controller 12 determines an accumulated measure TP_NOX representing the total tailpipe $NO_x$ emissions (in grams) since the start of the immediately-prior $NO_x$ purge or desulfurization event, based upon the adjusted second output signal SIGNAL2 generated by the $NO_x$ sensor 140 and determined air mass value AM (at steps 216 and 218). Because both the current tailpipe emissions and the permissible emissions level are expressed in units of grams per vehicle-mile-traveled to thereby provide a more realistic measure of the emissions performance of the vehicle, in step 220, the controller 12 also determines a measure DIST_EFF_CUR representing the effective cumulative distance "currently" traveled by the vehicle, that is, traveled by the vehicle since the controller 12 last initiated a $NO_x$ purge event.

While the current effective-distance-traveled measure DIST_EFF_CUR is determined in any suitable manner, the controller 12 generates the current effective-distance-traveled measure DIST_EFF_CUR at step 20 by accumulating detected or determined values for instantaneous vehicle speed VS, as may itself be derived, for example, from engine speed N and selected-transmission-gear information. Further, in the exemplary system 10, the controller 12 "clips" the detected or determined vehicle speed at a minimum velocity VS_MIN, for example, typically ranging from perhaps about 0.2 mph to about 0.3 mph (about 0.3 km/hr to about 0.5 km/hr), in order to include the corresponding "effective" distance traveled, for purposes of emissions, when the vehicle is traveling below that speed, or is at a stop. Most preferably, the minimum predetermined vehicle speed VS_MIN is characterized by a level of $NO_x$ emissions that is at least as great as the levels of $NO_x$ emissions generated by the engine 12 when idling at stoichiometry.

At step 222, the controller 12 determines a modified emissions measure NOX_CUR as the total emissions measure TP_NOX divided by the effective-distance-traveled measure DIST_EFF_CUR. As noted above, the modified emissions measure NOX_CUR is favorably expressed in units of "grams per mile."

Because certain characteristics of current vehicle activity impact vehicle emissions, for example, generating increased levels of exhaust gas constituents upon experiencing an increase in either the frequency and/or the magnitude of changes in engine output, the controller 12 determines a measure ACTIVITY representing a current level of vehicle activity (at step 224 of FIG. 2) and modifies a predetermined maximum emissions threshold NOX_MAX_STD (at step 226) based on the determined activity measure to thereby obtain a vehicle-activity-modified activity-modified $NO_x$-per-mile threshold NOX_MAX which seeks to accommodate the impact of such vehicle activity.

While the vehicle activity measure ACTIVITY is determined at step 224 in any suitable manner based upon one or more measures of engine or vehicle output, including but not limited to a determined desired power, vehicle speed VS, engine speed N, engine torque, wheel torque, or wheel power, the controller 12 generates the vehicle activity measure ACTIVITY based upon a determination of instantaneous absolute engine power Pe, as follows:

$$Pe=TQ*N*k_I,$$

where TQ represents a detected or determined value for the engine's absolute torque output, N represents engine speed, and $k_I$ is a predetermined constant representing the system's moment of inertia. The controller 12 filters the determined values Pe over time, for example, using a high-pass filter $G_1(s)$, where s is the Laplace operator known to those skilled in the art, to produce a high-pass filtered engine power value HPe. After taking the absolute value AHPe of the high-pass-filtered engine power value HPe, the resulting absolute value AHPe is low-pass-filtered with filter $G_1(s)$ to obtain the desired vehicle activity measure ACTIVITY.

Similarly, while the current permissible emissions lend NOX_MAX is modified in any suitable manner to reflect current vehicle activity, in the exemplary system 10, at step 226, the controller 12 determines a current permissible emissions level NOX_MAX as a predetermined function $f_5$ of the predetermined maximum emissions threshold NOX_MAX_STD based on the determined vehicle activity measure ACTIVITY. By way of example only, in the exemplary system 10, the current permissible emissions level NOX_MAX typically varies between a minimum of about 20 percent of the predetermined maximum emissions threshold NOX_MAX_STD for relatively-high vehicle activity levels (e.g., for many transients) to a maximum of about seventy percent of the predetermined maximum emissions threshold NOX_MAX_STD (the latter value providing a "safety factor" ensuring that actual vehicle emissions do not exceed the proscribed government standard NOX_MAX_STD).

Referring again to FIG. 4, at step 228, the controller 12 determines whether the modified emissions measure NOX_CUR as determined in step 222 exceeds the maximum emissions level NOX_MAX as determined in step 226. If the modified emissions measure NOX_CUR does not exceed the current maximum emissions level NOX_MAX, the controller 12 remains free to select a lean engine operating condition in accordance with the exemplary system's lean-burn feature. If the modified emissions measure NOX_CUR exceeds the current maximum emissions level NOX_MAX, the controller 12 determines that the "fill" portion of a "complete" lean-burn fill/purge cycle has been completed, and the controller immediately initiates a purge event at step 230 by setting suitable purge event flags PRG_FLG and PRG_START_FLG to logical one.

If, at step 214 of FIG. 4, the controller 12 determines that a purge event has just been commenced, as by checking the current value for the purge-start flag PRG_START_FLG, the controller 12 resets the previously determined values TP_NOX_TOT and DIST_EFF_CUR for the total tailpipe $NO_x$ and the effective distance traveled and the determined modified emissions measure NOX_CUR, along with other stored values FG_NOX_TOT and FG_NOX_TOT_MOD (to be discussed below), to zero at step 232. The purge-start flag PRG_START_FLG is similarly reset to logic zero at that time.

The controller 12 further conditions enablement of the lean-burn feature upon a determination of a positive performance impact or "benefit" of such lean-burn operation over a suitable reference operating condition, for example, a near-stoichiometric operating condition at MBT. By way of example only, the exemplary system 10 uses a fuel efficiency measure calculated for such lean-burn operation with reference to engine operation at the near-stoichiometric operating condition and, more specifically, a relative fuel efficiency or "fuel economy benefit" measure. Other suitable performance impacts include, without limitation, fuel usage, fuel savings per distance traveled by the vehicle, engine efficiency, overall vehicle tailpipe emissions, and vehicle drivability.

Indeed, the invention contemplates determination of a performance impact of operating the engine and/or the vehicle's powertrain at any first operating mode relative to any second operating mode, and the difference between the first and second operating modes is not intended to be limited to the use of different air-fuel mixtures. Thus, the invention is intended to be advantageously used to determine or characterize an impact of any system or operating condition that affects generated torque, such as, for example, comparing stratified lean operation versus homogeneous lean operation, or determining an effect of exhaust gas recirculation (e.g., a fuel benefit can thus be associated with a given EGR setting), or determining the effect of various degrees of retard of a variable cam timing ("VCT") system, or characterizing the effect of operating charge motion control valves ("CMCV"), an intake-charge swirl approach, for use with both stratified and homogeneous lean engine operation).

More specifically, the controller 12 determines the performance impact of lean-burn operation relative to stoichiometric engine operation at MBT by calculating a torque ratio TR defined as the ratio, for a given speed-load condition, of a determined indicated torque output at a selected air-fuel ratio to a determined indicated torque output at stoichiometric operation, as described further below. In one embodiment, the controller determines the torque ratio TR based upon stored values for engine torque, mapped as a function of engine speed N, engine load LOAD, and air-fuel ratio LAMBSE.

Alternatively, the invention contemplates use of absolute torque or acceleration information generated, for example, by a suitable torque meter or accelerometer (not shown), with which to directly evaluate the impact of, or to otherwise generate a measure representative of the impact of, the first operating mode relative to the second operating mode. While the invention contemplates use of any suitable torque meter or accelerometer to generate such absolute torque or acceleration information, suitable examples include a strain-gage torque meter positioned on the powertrain's output shaft to detect brake torque, and a high-pulse-frequency Hall-effect acceleration sensor positioned on the engine's crankshaft. As a further alternative, the invention contemplates use, in determining the impact of the first operating mode relative to the second operating mode, of the above-described determined measure Pe of absolute instantaneous engine power.

Where the difference between the two operating modes includes different fuel flow rates, as when comparing a lean or rich operating mode to a reference stoichiometric operating mode, the torque or power measure for each operating mode is preferably normalized by a detected or determined fuel flow rate. Similarly, if the difference between the two operating modes includes different or varying engine speed-load points, the torque or power measure is either corrected (for example, by taking into account the changed engine speed-load conditions) or normalized (for example, by relating the absolute outputs to fuel flow rate, e.g., as represented by fuel pulse width) because such measures are related to engine speed and system moment of inertia.

It will be appreciated that the resulting torque or power measures can advantageously be used as "on-line" measures of a performance impact. However, where there is a desire to improve signal quality, i.e., to reduce noise, absolute instantaneous power or normalized absolute instantaneous power can be integrated to obtain a relative measure of work performed in each operating mode. If the two modes are characterized by a change in engine speed-load points, then the relative work measure is corrected for thermal efficiency, values for which may be conveniently stored in a ROM look-up table.

This concludes the description of the invention. The reading of it by those skilled in the art would bring to mind many alterations and modifications without departing from the spirit and the scope of the invention. Accordingly, it is intended that the scope of the invention is defined by the following claims:

What is claimed is:

1. A method for controlling an internal combustion engine coupled to an emission control device, the engine coupled to an exhaust sensor providing a first signal and a second signal respectively indicative of a first quantity and a second quantity, the method comprising:

determining when the second signal deviates from the second quantity based on the first signal;

adjusting the second signal in response to said determination; and adjusting an engine operating parameter based on the adjusted second signal.

2. The method recited in claim 1, wherein said engine operating parameter is an exhaust air-fuel ratio of the engine.

3. The method recited in claim 1, wherein the first signal is an equivalence ratio.

4. The method recited in claim 1, wherein the second quantity is an amount of an exhaust constituent in parts per million.

5. The method recited in claim 1, wherein said step of adjusting the second signal comprises setting the second signal to a calculated value.

6. The method recited in claim 4, wherein the exhaust constituent comprises nitrogen oxide.

7. The method recited in claim 5, wherein said calculated value is a product of an integrated engine exhaust air-flow over a time interval and the second signal at the end of said time interval.

8. The method recited in claim 1, wherein said step of adjusting of said engine operating parameter comprises adjusting a fuel flow rate.

9. The method recited in claim 1, wherein said step of determining when the second signal deviates from the second quantity based on the first signal further comprises determining when the first signal is less than a predetermined value.

10. The method recited in claim 1, wherein said step of adjusting of the second signal ends when the second quantity exceeds a predetermined value.

11. A control system for use with a vehicle having an internal combustion engine coupled to an emission control device, the system comprising:

an exhaust sensor coupled downstream of the emission control device for providing a first signal and a second signal; and a controller coupled to the engine and said exhaust sensor for determining a start of a time interval when said first signal is richer than a first threshold, determining an end of said time interval when said first signal is leaner than a second threshold, and modifying said second signal during said time interval.

12. The system recited in claim 11, wherein said first signal comprises an air-fuel ratio.

13. The system recited in claim 12, wherein said second signal comprises an exhaust constituent.

14. The system recited in claim 13, wherein modifying said second signal further comprises setting said second signal to a product of an integrated engine exhaust air flow over said time interval and said second signal at the end of said time period.

15. A control system for use with a vehicle having an internal combustion engine coupled to an emission control device, the system comprising:

an exhaust sensor coupled downstream of the emission control device for providing a first and a second signal respectively indicative of an exhaust air-fuel ratio and an exhaust constituent;

a controller coupled to the engine and said sensor for determining a start of a time interval when said first signal is richer than a first threshold, determining an end of said time interval when said first signal is leaner than a second threshold; and modifying said second signal during said interval, wherein said modifying comprises setting said second signal to a product of an integrated air flow over said time interval and said second signal at said end of said time interval.

16. A method for controlling an internal combustion engine coupled to an emission control device, the engine coupled to an exhaust sensor providing a first signal and a second signal respectively indicative of an exhaust gas air-fuel ratio and a $NO_x$ level, the method comprising:

determining the $NO_x$ level based on a first engine operating parameter when the first signal indicates the exhaust air-fuel ratio is richer than a first predetermined value, determining the $NO_x$ level based on the second signal when the first signal indicates the exhaust air-fuel ratio is leaner than a second predetermined value and reductant deposited on the sensor is depleted by excess oxygen in the lean exhaust gas; and adjusting a second engine operating parameter based on said determined $NO_x$ level.

17. The method recited in claim 16, wherein said first engine operating parameter is an engine air flow.

18. The method recited in claim 16, wherein said second engine operating parameter is an engine air-fuel ratio.

19. The method recited in claim 16, wherein said first predetermined value is stoichiometry.

20. The method recited in claim 16, wherein said second predetermined value is stoichiometry.

21. The method recited in claim 16 further comprising indicating that the second signal correctly represents the $NO_x$ level when a reductant deposited on the sensor is depleted by excess $O_2$.

22. A method for estimating the concentration of $NO_x$ exhaust emissions of an internal combustion engine having a one or more sensors for measuring exhaust concentration of oxygen and $NO_x$, the method comprising:

measuring the exhaust oxygen concentration;

measuring the exhaust $NO_x$ concentration;

deriving a $NO_x$ emission estimate based upon the measured exhaust $NO_x$ concentration;

deriving a correction signal, when the measured exhaust oxygen level exceeds a predetermined level, to compensate for an erroneous measurement of the exhaust $NO_x$ concentration; and adjusting the $NO_x$ emission estimate based upon said corrected signal.

23. The method recited in claim 22, wherein said step of deriving said correction signal comprises setting said correction signal to a product of an integrated air flow over a time period during which said erroneous measurement of the exhaust $NO_x$ concentration occurred and the exhaust $NO_x$ concentration at the end of said time period.

* * * * *